US008157262B2

(12) United States Patent
Sakano

(10) Patent No.: US 8,157,262 B2
(45) Date of Patent: Apr. 17, 2012

(54) RECORDING APPARATUS HAVING SHIFTABLE CONVEYOR UNIT

(75) Inventor: Yuji Sakano, Toyota (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 149 days.

(21) Appl. No.: 12/370,290

(22) Filed: Feb. 12, 2009

(65) Prior Publication Data

US 2009/0218761 A1 Sep. 3, 2009

(30) Foreign Application Priority Data

Feb. 28, 2008 (JP) ..... 2008-047661

(51) Int. Cl.
*B65H 5/02* (2006.01)

(52) U.S. Cl. ..... 271/275; 347/104; 399/124

(58) Field of Classification Search ..... 271/273–275; 347/104; 399/124
See application file for complete search history.

(56) References Cited

U.S. PATENT DOCUMENTS

| | | | | |
|---|---|---|---|---|
| 6,189,684 | B1 * | 2/2001 | Greive | 198/835 |
| 7,054,585 | B2 * | 5/2006 | Sasamoto et al. | 399/299 |
| 7,118,103 | B2 * | 10/2006 | Greive | 271/275 |
| 7,500,733 | B2 * | 3/2009 | Takagi et al. | 347/35 |
| 8,025,392 | B2 * | 9/2011 | Yamamoto | 347/104 |
| 2002/0098009 | A1 * | 7/2002 | Nakamura et al. | 399/124 |
| 2005/0275706 | A1 * | 12/2005 | Takagi et al. | 347/104 |
| 2009/0189966 | A1 * | 7/2009 | Sugimoto et al. | 347/104 |

FOREIGN PATENT DOCUMENTS

| | | | |
|---|---|---|---|
| JP | 60137740 | A * | 7/1985 |
| JP | 2002-002999 | A | 1/2002 |
| JP | 2006-264076 | A | 10/2006 |
| JP | 2006-282296 | A | 10/2006 |

OTHER PUBLICATIONS

Japan Patent Office; Notice of Reasons for Rejection in Japanese Patent Application No. 2008-047661 (counterpart to the above-captioned U.S. patent application) mailed Apr. 20, 2010.

* cited by examiner

*Primary Examiner* — Jeremy R Severson
(74) *Attorney, Agent, or Firm* — Baker Botts L.L.P.

(57) ABSTRACT

The recording apparatus includes: a recording head having a recording surface; a conveyor unit having three rollers, and a conveyor belt looped around the rollers; and a roller moving mechanism. The mechanism moves at least one of the three rollers so as to allow the conveyor unit to shift between a first state and a second state. In the first state, an image can be formed by the recording head to a recording medium. A conveyor surface faces the recording surface with a predetermined gap therebetween, and the three rollers are in a predetermined relative positional relation so as to apply tension to the conveyor belt. In the second state, a gap larger than the predetermined gap exists between the conveyor surface and the recording surface, and the three rollers are in a relative positional relation different from the predetermined relative positional relation.

15 Claims, 5 Drawing Sheets

RECORDING APPARATUS HAVING SHIFTABLE CONVEYOR UNIT

CROSS REFERENCE TO RELATED APPLICATION

The present application claims priority from Japanese Patent Application No. 2008-47661, which was filed on Feb. 28, 2008, the disclosure of which is herein incorporated by reference in its entirety.

BACKGROUND OF THE INVENTION

1. Field of the Invention

The present invention relates to a recording apparatus which performs recording to a recording medium.

2. Description of the Related Art

A known image forming device incorporates a recording head and a conveyor unit, which conveyor unit has a recording medium adhered thereon and conveys the recording medium to a position where the recording medium faces the recording head. When a recording medium is jammed between the recording head and the conveyor unit in the image forming device, the conveyor unit withdraws downward so as to create a space large enough for a user to place a hand therein.

SUMMARY OF THE INVENTION

In the image forming device, the conveyor unit includes: three rollers consist of a drive roller, a driven roller, and a tension roller; and a belt looped around the three rollers. When a recording medium is jammed, the conveyor unit moves down while maintaining a relative positional relation of the three rollers. A large space is required below the conveyor unit in order to move the conveyor unit when the same relative positional relation of the three rollers of the conveyor unit is maintained before and after the conveyor unit moves. Providing a large space below the conveyer unit will make the image forming device larger with respect to a height direction.

A need has arisen for a recording apparatus which allows a jammed recording medium to be easily removable while realizing a smaller body.

The recording apparatus may include: a recording head which has a recording surface and forms an image on a recording medium; a conveyor unit which has three rollers parallel to each other, and a conveyor belt looped around the three rollers; and a roller moving mechanism. The roller moving mechanism moves at least one of the three rollers so as to allow the conveyor unit to shift between a first state and a second state. The first state is the state where an image can be formed by the recording head to a recording medium supported to a conveyor surface. The conveyor surface is defined on an outer circumferential surface of the conveyor belt by two of the three rollers. In the first state, a conveyor surface faces the recording surface with a predetermined gap therebetween, and the three rollers are in a predetermined relative positional relation so as to apply tension to the conveyor belt. The second state is the state where a gap larger than the predetermined gap exists between the conveyor surface and the recording surface, and the three rollers are in a relative positional relation different from the predetermined relative positional relation.

Accordingly, the gap between the conveyor surface and the recording surface expands when the conveyor unit is shifted from the first state to the second state. This allows a jammed recording medium to be easily removed. Further, a shape of the conveyor belt is changed into a spatially advantageous shape by changing the relative positional relation of the three rollers. This realizes a smaller recording apparatus. Note that in the present invention, "a gap larger than the predetermined gap exists between the conveyor surface and the recording surface" includes a case where at least a part of the conveyor surface, preferably the entire surface, is located farther apart than the predetermined gap from the recording head.

BRIEF DESCRIPTION OF THE DRAWINGS

Other and further objects, features and advantages of the invention will appear more fully from the following description taken in connection with the accompanying drawings in which.

DESCRIPTION OF THE EMBODIMENTS

Figure 1:
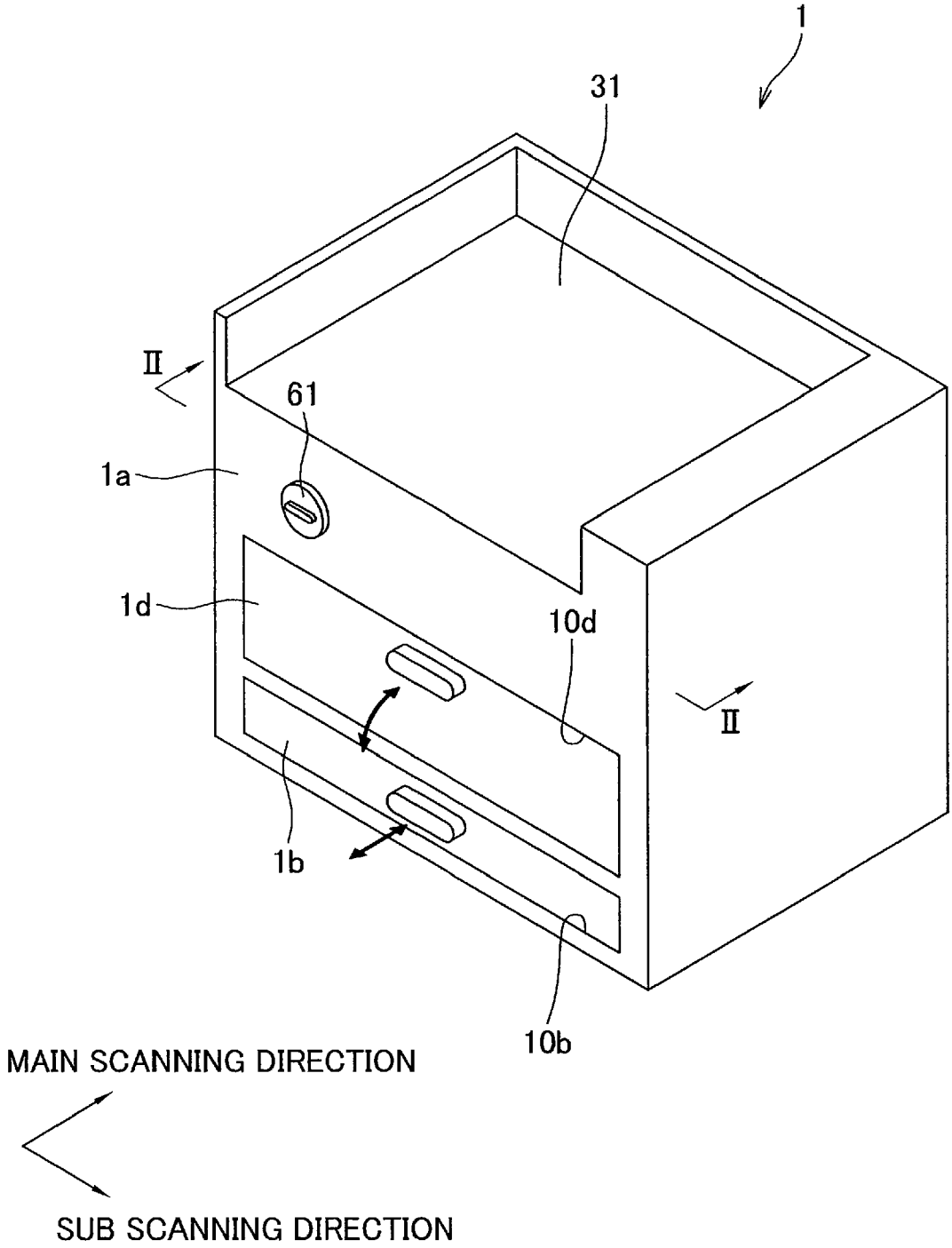
FIG. 1 is a perspective view illustrating an exterior view of an inkjet printer according to a first embodiment of the present invention.

FIG. 1 illustrates an inkjet printer 1 according to a first embodiment of the present invention. As illustrated in FIG. 1, the printer 1 has a rectangular parallelepiped housing 1*a*. On a side surface of the housing 1*a*, preferably a front surface, the following members are provided in this order from the top of the housing 1*a*: a rotating knob 61 which rotates according to a user's operation; an opening 10*d*; and an opening 10*b*. Provided to the opening 10*d* is an openable door 1*d*. The door 1*d* is outwardly swingable around a horizontal shaft near a lower end of the opening 10*d* towards outside of the housing 1*a*. In the housing 1*a* is a sheet feed unit 1*b* inserted from the opening 10*b*. A user is able to pull out the sheet feed unit 1*b* from the housing 1*a* by pulling the sheet feed unit 1*b* in a horizontal direction. An upper surface of the housing 1*a* is a sheet discharge site 31 where a plurality of printed sheets P are stacked.

Figure 2:
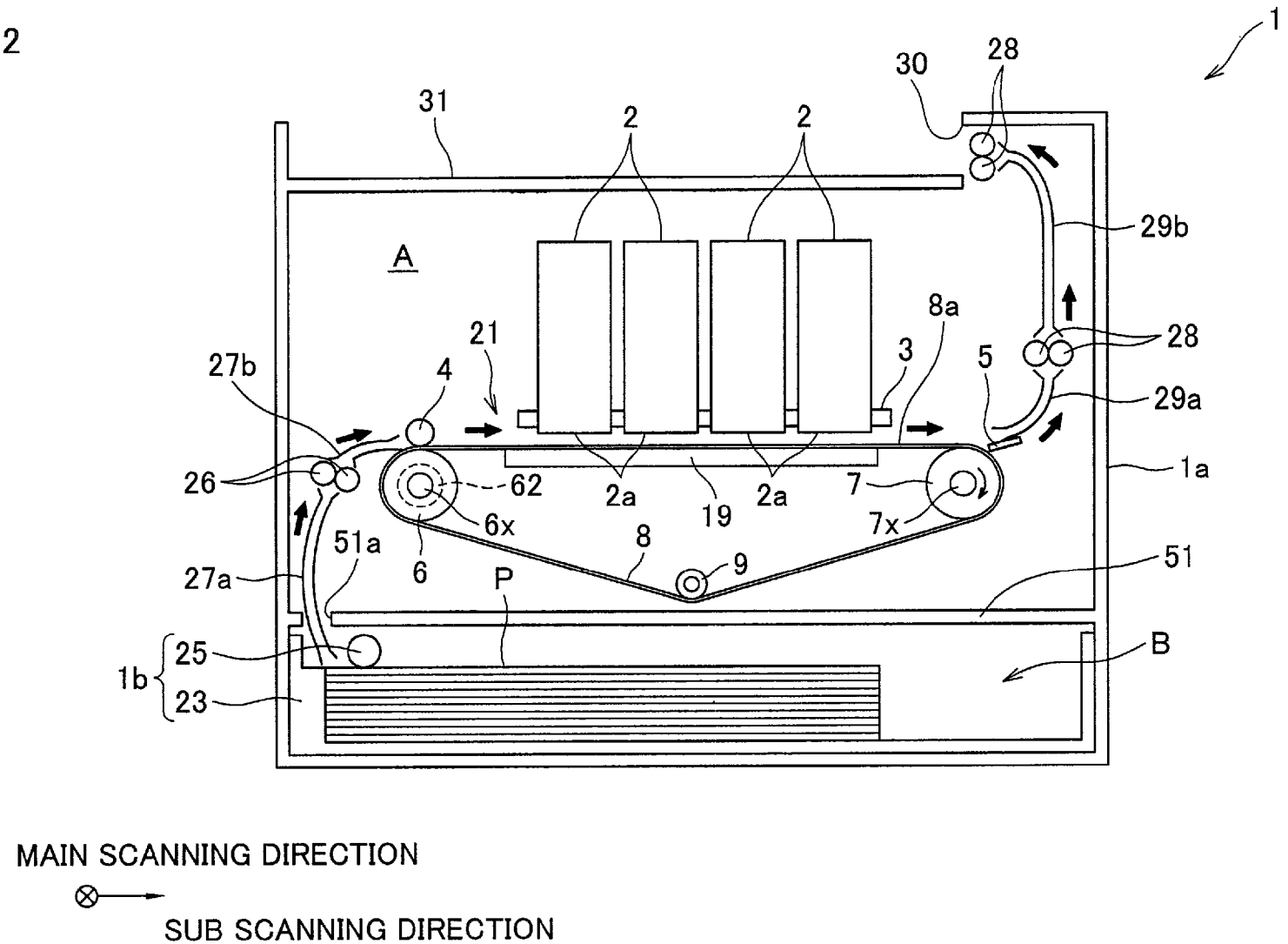
FIG. 2 is a cross-sectional view of the inkjet printer taken along the II-II line of FIG. 1.

As illustrated in FIG. 2, inside the housing 1*a* is divided into two spaces: a space A and a space B, by a partition plate 51. In the space A are four inkjet heads 2 and a conveyor unit 21. The four inkjet heads 2 respectively eject four different colors of ink: magenta, cyan, yellow, and black. The space B located below the space A is a space where the sheet feed unit 1*b* is disposed when the sheet feed unit 1*b* attachable to the housing 1*a* is attached to the housing 1*a* through the opening 10*b*. The sheet feed unit 1*b* is detached from the housing 1*a* in a main scanning direction (direction perpendicular to the surface of FIG. 2).

In the present embodiment, a sub scanning direction of the inkjet heads 2 is parallel to a direction in which the conveyor unit 21 conveys a sheet P; i.e., conveyance direction. The main scanning direction of the inkjet heads 2 is in a horizontal plane and is perpendicular to the sub scanning direction. A side wall of the housing 1*a* to which the door 1*d* is provided, is along the conveyance direction of a sheet P. The vertical position of the door 1*d* is substantially the same as that of an area between an upper part of the conveyor unit 21 and lower ends of the four inkjet heads 2. Thus, a user is able to see the area in the housing 1*a* in the main scanning direction when s/he opens the door 1*d*.

Inside the printer 1 is a conveyance path formed from the sheet feed unit 1*b* to the sheet discharge site 31 in the direction indicated by the bold arrows in FIG. 2. The sheet feed unit 1*b* includes a sheet feed tray 23 capable of stacking and storing a plurality of sheets P therein, and a pickup roller 25 which sends out the sheets P from the sheet feed tray 23 sheet by sheet. The roller 25 sends out the uppermost one of the stacked sheets P stored in the sheet feed tray 23. Inside the housing 1*a* are two conveyance guides 27*a* and 27*b* curved and extending from an upper end of the sheet feed tray 23 to an upper surface of the conveyor unit 21. Between the conveyance guide 27*a* and the conveyance guide 27*b* are a feed roller pair 26. The pickup roller 25 and the feed roller pair 26 are driven to send out the sheet P to the conveyor unit 21 through the conveyance guides 27*a* and 27*b*.

The conveyor unit 21 includes two belt rollers 6 and 7, an endless conveyor belt 8 looped around the belt rollers 6 and 7, and a tension roller 9. The tension roller 9 is rotatably supported by the housing 1*a*. The tension roller 9 is provided inside the loop formed by the conveyor belt 8 but below the belt rollers 6 and 7, where the tension roller 9 contacts an inner circumferential surface of the conveyor belt 8 and is able to apply tension to the conveyor belt 8. The belt roller 7, which is a drive roller, rotates clockwise in FIG. 2 with a rotation force applied by a not-illustrated drive source to a shaft 7*x* of the belt roller 7. The belt roller 6, which is a driven roller, has a shaft 6*x*. The belt roller 6 rotates clockwise in FIG. 2 as the conveyor belt 8 runs as the belt roller 7 rotates. The tension roller 9 also rotates clockwise in FIG. 2 as the conveyor belt 8 runs. As described below, portions of both ends of the shaft 6*x* of the belt roller 6 is respectively inserted into two slits 64 each formed on plates 65 and 66 fixed to the housing 1*a* (see FIG. 3B).

As illustrated in FIG. 2, the four inkjet heads 2 are aligned in the conveyance direction of the sheet P, and fixed to the housing 1*a* via a frame 3. In other words, the printer 1 is a line printer. Each of the inkjet heads 2 has a rectangular parallelepiped shape long in the main scanning direction. A bottom surface of the each of the inkjet heads 2 functions as an ejection surface 2*a* which faces a conveyor surface 8*a* in a later-described conveyable state. The conveyor surface 8*a* is an upper side of an outer circumferential surface of the conveyor belt 8. The conveyor surface 8*a* is a flat surface part of the conveyor belt 8 between the belt rollers 6 and 7, and is parallel to the conveyance direction. The ejection surface 2*a* has a plurality of not-illustrated ejection openings formed thereon, which ejection openings eject ink droplets. Ink droplets of the respective colors are ejected from the ejection openings towards an upper surface of a sheet P serving as a print surface when the sheet P conveyed supported on the conveyor surface 8*a* of the conveyor belt 8 sequentially passes below the four inkjet heads 2. Thus, a desired color image is formed on the sheet P.

The outer circumferential surface of the conveyor belt 8 has adhesion applied by silicone treatment. A nip roller 4 is provided in the conveyance path. The nip roller 4 faces the belt roller 6 interposing the conveyor belt 8 therebetween. The nip roller 4 pushes down a sheet P towards the conveyor surface 8*a* of the conveyor belt 8, the sheet P having been sent out from the sheet feed unit 1*b*. The sheet P pushed onto the conveyor surface 8*a* is conveyed to the right in FIG. 2 while being kept on the conveyor surface 8*a* by the adhesion.

Figure 3A:
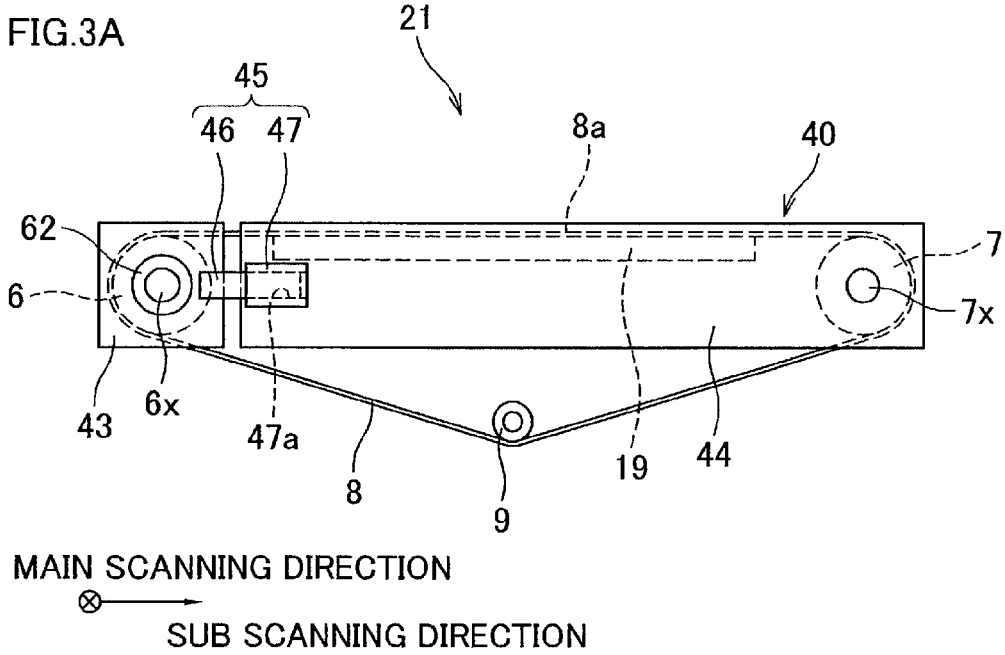
FIG. 3A and FIG. 3B are a side view and a plan view of the conveyor unit illustrated in FIG. 2, respectively.
Figure 3B:
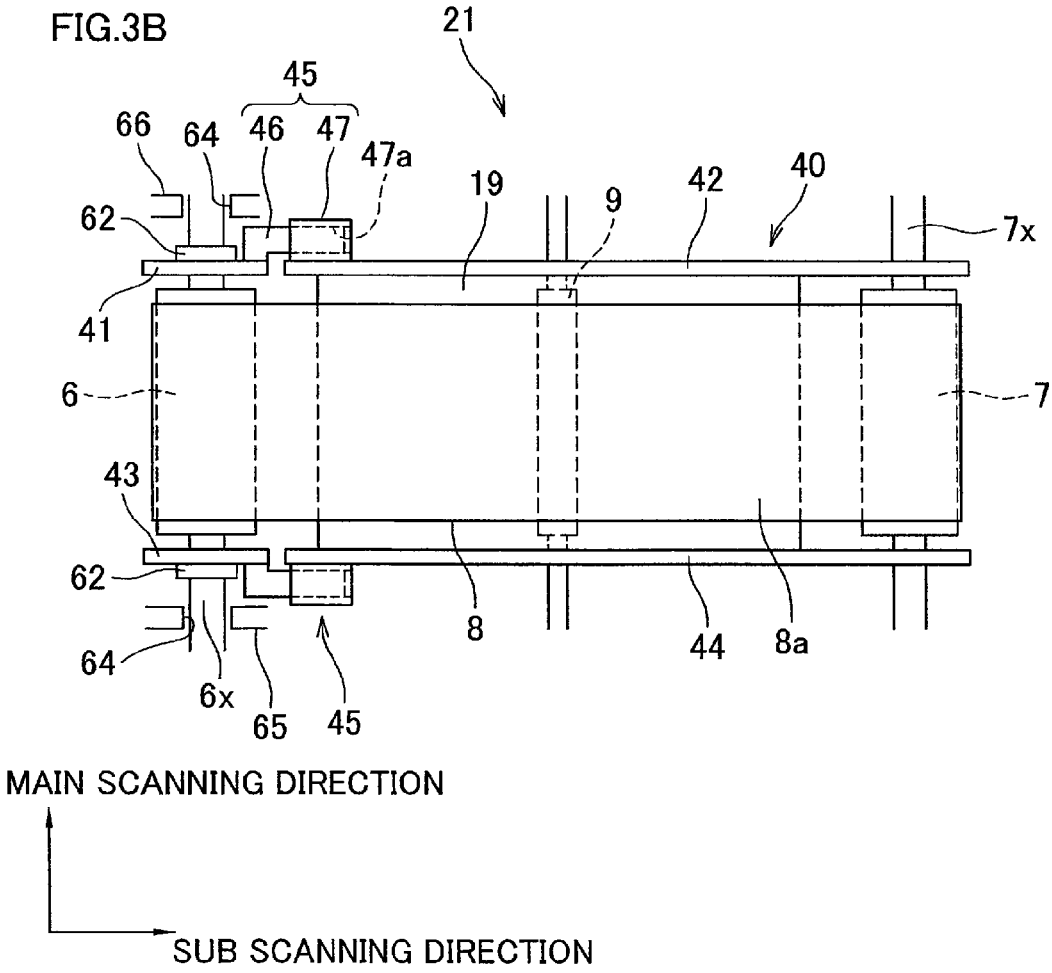

The belt rollers 6 and 7 are rotatably supported by a support frame 40 as illustrated in FIGS. 3A and 3B. The support frame 40 includes four plates: plates 41 to 44. Each of the plates 41 and 43 is a substantial square. The plates 41 and 43 are provided facing each other to sandwich the belt roller 6 in its shaft direction; i.e., the main scanning direction, and rotatably support the belt roller 6. Each of the plates 42 and 44 is a substantial rectangle. The plates 42 and 44 are provided facing each other to sandwich the belt roller 7 in its shaft direction, and rotatably support the belt roller 7. The plates 42 and 44 extend parallel to one another from a position where the plates 42 and 44 face the belt roller 7 towards the plates 41 and 43.

Between the plate 41 and the plate 42 is a slide mechanism 45. The slide mechanism 45 enables the plate 41 to slide relative to the plate 42 in a longitudinal direction of the plate 42. The slide mechanism 45 includes a slider 46 fixed to the plate 41 and extends in the sub scanning direction, and a U-shaped piece 47 whose cross-sectional shape is a U. The U-shaped piece 47 is fixed to an outside surface of the plate 42 at both ends so that a shaft direction of the U-shaped piece 47 matches the longitudinal direction of the plate 42. Thus, between the U-shaped piece 47 and the plate 42 is a through hole 47*a* capable of accommodating therein a portion of the leading end of the slider 46. A slide mechanism 45 is also provided between the plate 43 and the plate 44. Thus, the two sliders 46 are respectively guided by the U-shaped pieces 47 to move in the longitudinal direction of the plates 42 and 44. This allows the belt roller 6 to move with respect to the belt roller 7 so as to change the distance between the shafts of the belt roller 6 and the belt roller 7.

As illustrated in FIG. 1, inside the housing 1*a* is the partition plate 51 provided as a type of an adjoining member which divides the inner space of the housing 1*a* into the space A and the space B. The partition plate 51 faces the entire area of the conveyor unit 21 in a vertical direction. Thus, the partition plate 51 is able to receive a foreign material even if a foreign material such as ink falls from any part of the conveyor unit 21. This restrains a foreign material from adhering to the sheet feed unit 1*b* or a sheet P inside the space B. The partition plate 51 has a hole 51*a* formed in a position thereof where the partition plate 51 does not face the conveyor unit 21. The guide 27*a* extends from the space B to the space A through the hole 51*a*. An upper surface of the partition plate 51 facing the space A where the four inkjet heads 2 are provided is prone to contamination due to adhesion of ink.

A separation plate 5 is provided to a position in the conveyance path, the position facing the belt roller 7 interposing the conveyor belt 8. The separation plate 5 separates a sheet P kept on the conveyor surface 8*a* of the conveyor belt 8 from the conveyor surface 8*a*. Inside the housing 1*a* are two conveyance guides: conveyance guides 29*a* and 29*b* curved and extending from an upper surface of the separation plate 5 towards the sheet discharge site 31. One discharge roller pair 28 are provided between the conveyance guide 29*a* and the conveyance guide 29*b*. The other discharge roller pair 28 are provided between the conveyance guide 29*b* and the sheet discharge site 31. These two discharge roller pairs 28 are driven to discharge the sheet P separated from the conveyor surface 8*a* to the sheet discharge site 31 through the conveyance guides 29*a* and 29*b*.

Inside the loop formed by the conveyor belt 8 is a substantially rectangular parallelepiped platen 19 provided facing the four inkjet heads 2. The platen 19 is fixed at its both ends in the main scanning direction to the plates 42 and 44, as illustrated in FIG. 3B. An upper surface of the platen 19 is in contact with the inner circumferential surface of the conveyor belt 8. That is, the platen 19 supports the conveyor belt 8 from the inside. This allows the conveyor surface 8*a* and lower surfaces of the four inkjet heads 2; i.e., ejection surfaces 2*a* to parallel each other, creating a slight gap between the ejection surfaces 2*a* and the conveyor surface 8*a* in a conveyable state. The gap constitutes a part of the conveyance path.

Figure 4A:
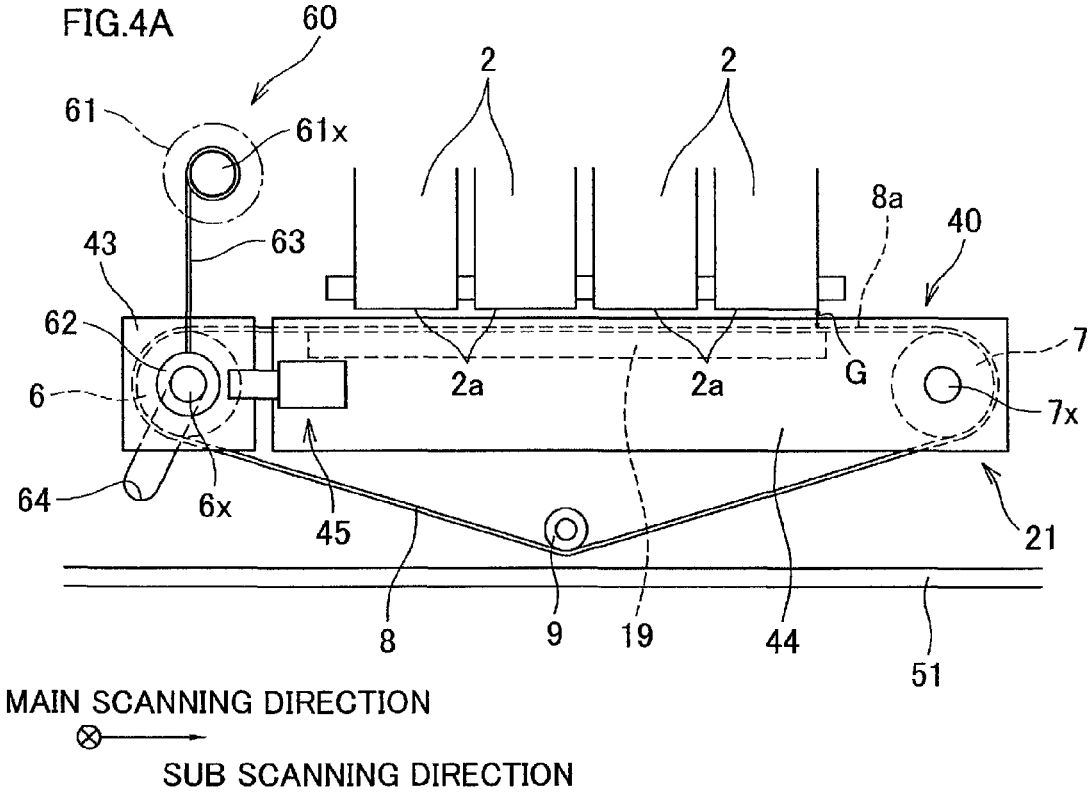
FIG. 4A and FIG. 4B are side views of moving processes of a belt roller.
Figure 4B:
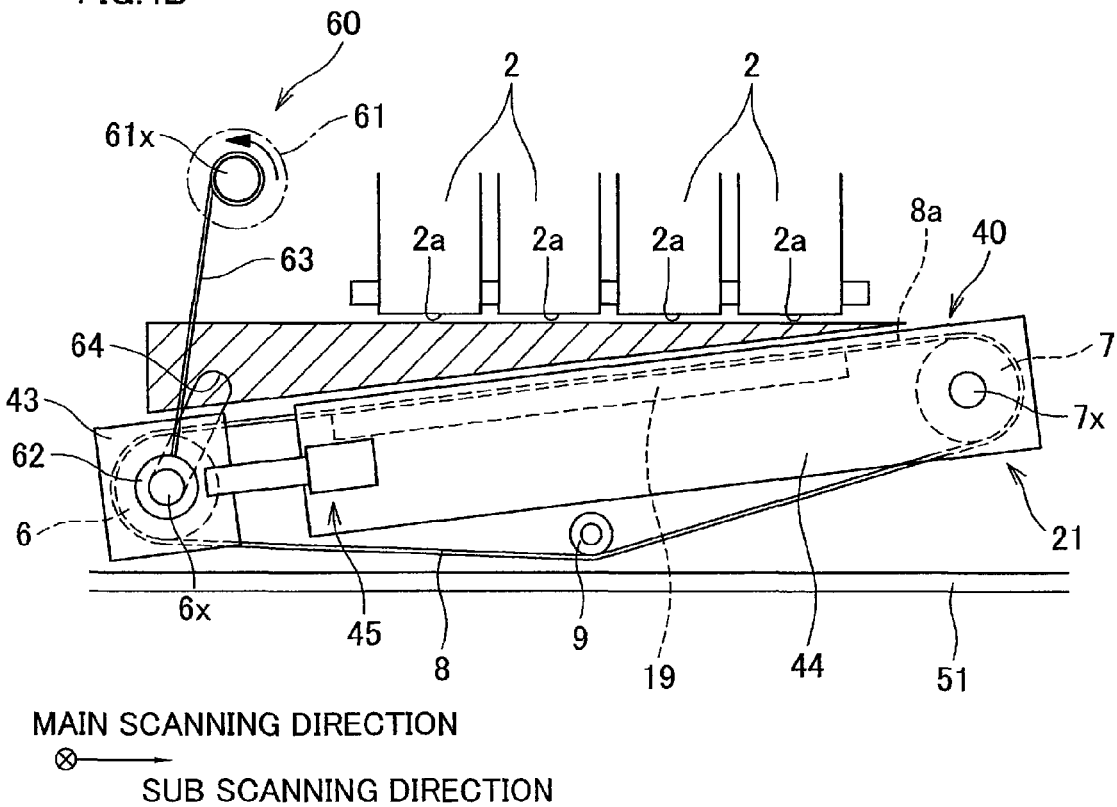

The following describes shifting of states of the conveyor unit 21 by moving the belt roller 6, with reference to FIGS. 4A and 4B.

The printer 1 is provided with a roller moving mechanism 60. The roller moving mechanism 60 shifts the conveyor unit 21 between the conveyable state; i.e., first state and a withdrawal state; i.e., second state, by moving the belt roller 6 which is a driven roller. In the conveyable state, the belt roller 6 is at such a position where the conveyor surface 8*a* faces the ejection surfaces 2*a* with a predetermined gap G therebetween, the conveyor surface 8*a* being defined on the outer circumferential surface of the conveyor belt 8 by the belt rollers 6 and 7. At this time, the conveyor surface 8*a* and the ejection surfaces 2*a* parallel each other. The tension roller 9 is located below the belt rollers 6 and 7, and pushes down the inner circumferential surface of the conveyor belt 8 so as to apply tension to the conveyor belt 8. Conveyance of a sheet P by the conveyor unit 21 and printing on the sheet P by the four inkjet heads 2 are performed when the conveyor unit 21 is in the conveyable state. The relative positional relation of the three rollers 6, 7, and 9 in the conveyable state is hereinafter referred to as "predetermined relative positional relation."

Meanwhile in the withdrawal state, the belt roller 6 is at such a position where a gap larger than a predetermined gap G exists between the entire conveyor surface 8*a* and the ejection surfaces 2*a*, and where the belt roller 6 is tilted substantially at twenty degrees with respect to the ejection surfaces 2*a*. Thus in the withdrawal state, the separation between the conveyor surface 8*a* and the plane including therein the four ejection surfaces 2*a* increases in the direction of the belt roller 6. In detail, when the state shifts from the conveyable state to the withdrawal state, the belt roller 6 moves to a position obliquely above the tension roller 9, or alternatively, to the same level as the tension roller 9. The movement of the belt roller 6 is along the rectilinear path tilted substantially at seventy degrees with respect to the horizontal direction, so as to separate from both the belt roller 7 and a plane including therein the four ejection surfaces 2*a*. The belt roller 7 and the tension roller 9 remain at the same positions in the withdrawal state as in the conveyable state. Thus, the relative positional relation of the three rollers 6, 7, and 9 in the withdrawal state differs from the predetermined relative positional relation in the conveyable state because the roller 6 has moved. In the present embodiment, the roller 6 moves in such a manner that the total length of the conveyor belt 8 is longer in the withdrawal state than in the conveyable state. Thus, tension is applied to the conveyor belt 8 even in the withdrawal state. This prevents the conveyor belt 8 from loosening even in the withdrawal state.

The roller moving mechanism 60 includes: the rotating knob 61, two rings 62, two wires 63 as connecting members, and plates 65 and 66 (see FIG. 3B). Each of the wires 63 connects a ring 62 and a shaft 61*x* of the rotating knob 61. Each of the plates 65 and 66 has a slit 64 formed thereon. The slits 64 define the rectilinear path of the movement of the belt roller 6, and guide the belt roller 6 when it moves. The two rings 62 are respectively fixed to outer side surfaces of the plates 41 and 43. The shaft 6*x* of the belt roller 6 penetrates the rings 62 and the plates 41 and 43, enabling the belt roller 6 to rotate around the shaft 6*x*. In the present embodiment, the two slide mechanisms 45 and the two slits 64 constitute a guide mechanism which guides the belt roller 6 when it moves.

Portions of leading ends of the shaft 6*x* is inserted into the slits 64 formed on the plates 65 and 66. A width of each of the slits 64 is slightly larger than a diameter of the shaft 6*x*, which allows the shaft 6*x* to freely move along the slits 64. Each of the slits 64 has an elongated form extending obliquely towards the lower left in FIG. 4A. An upper end of the slit 64 is the position of the shaft 6*x* when the conveyor unit 21 is in the conveyable state. A lower end of the slit 64 is the position of the shaft 6*x* when the conveyor unit 21 is in the withdrawal state. The slit 64 has such a form that a distance between the slit 64 and the tension roller 9 is the smallest at the upper end of the slit 64. The distance between the slit 64 and the tension roller 9 increases in the direction of the lower end of the slit 64. Thus, the length of the conveyor belt 8 between the belt roller 6 and the tension roller 9 is the shortest when the belt roller 6 is at the upper ends of the slits 64. Thus, as described above, tension is constantly applied to the conveyor belt 8. The magnitude of the tension applied to the conveyor belt 8 increases as the belt roller 6 approaches the lower ends of the slits 64. Further, each of the slit 64 has such a form that the distance between the slit 64 and the belt roller 7 is the smallest at the upper end of the slit 64. The distance between the slit 64 and the belt roller 7 increases in the direction of the lower end of the slit 64.

One end of each of the wires 63 is fixed to an upper end of a ring 62. The other end of each of the wires 63 is fixed to the shaft 61*x* of the rotating knob 61. When the shaft 61*x* rotates counterclockwise to unwind the wires 63 from the shaft 61*x*, the shaft 6*x* of the belt roller 6 is guided to move down along the slits 64 accordingly. Reversely, when the shaft 61*x* rotates clockwise to wind the wires 63 around the shaft 61*x*, the shaft 6*x* of the belt roller 6 is guided to move up along the slits 64 accordingly. Thus, a user is able to move the belt roller 6 by rotating the rotation knob 61 in a desired direction to shift the conveyor unit 21 between the conveyable state and the withdrawal state. Load is applied clockwise to the shaft 61*x* of the rotating knob 61 by, for example, a not-illustrated gear or a clutch spring so as to prevent the wires 63 from unwinding with the weight of the belt roller 6 in the conveyable state, and to prevent a downward movement speed of the belt roller 6 from being excessively fast. Therefore, the user rotates the rotating knob 61 against the load.

When a sheet P jams between the conveyor unit 21 and the inkjet heads 2 during printing or the like, a user performs a state shifting operation to shift the conveyor unit 21 from the conveyable state to the withdrawal state in order to remove the jammed sheet P.

In the state shifting operation, the user rotates the rotating knob 61 counterclockwise in FIG. 4A. This unwinds the wires 63 from the shaft 61*x*, and the shaft 6*x* accordingly moves obliquely towards the lower left along the slits 64 with the rings 62. The shaft 6*x* stops at the lower end of the slits 64 as illustrated in FIG. 4B. At this time, the plates 42 and 44 and the platen 19 swing about the shaft 7*x* counterclockwise as the belt roller 6 moves downward. As described above, the distance between the slits 64 and the belt roller 7 is the smallest at the upper ends of the slits 64, and the distance increases in the direction of the lower ends of the slits 64. Thus, as the shaft 6*x* moves downward, the belt roller 6 moves with the sliders 46 guided by the U-shaped pieces 47 and the plate 41 and 43 to which the sliders 46 are fixed, towards a direction away from the belt roller 7 and the plates 42 and 44.

Thus, in the withdrawal state illustrated in FIG. 4B, the rollers 7 and 9 among the rollers 6, 7, and 9 included in the conveyor unit 21 are positioned at the same positions as in the conveyable state. Meanwhile in the withdrawal state illustrated in FIG. 4B, the belt roller 6 is at a position different from the position in the conveyable state. In more detail in the withdrawal state, the distance between the shafts of the belt rollers 6 and 7 is longer than in the conveyable state, and the belt roller 6 is at a position higher than the tension roller 9 in the vertical direction, or alternatively, at the same level as the tension roller 9.

In the present embodiment, the roller moving mechanism 60 moves the belt roller 6 without allowing the partition plate 51 adjacent to the conveyor belt 8 to contact the conveyor belt 8 in the conveyable state or in the withdrawal state. At this time, the conveyor belt 8 does not loosen in the withdrawal state due to the tension applied to the conveyor belt 8. Further in the withdrawal state, the belt roller 6 is at a higher position than the tension roller 9 in the vertical direction. This prevents a region of the conveyor belt 8 between the rollers 6 and 9, or a region of the conveyor belt 8 between the rollers 7 and 9 from reaching below the tension roller 9, contacting the upper surface of the partition plate 51. Thus, a foreign material on the partition plate 51 such as ink does not adhere to the conveyor belt 8. Especially in the present embodiment, the roller moving mechanism 60 moves the belt roller 6 without allowing the conveyor belt 8 to contact the partition plate 51 while the state is shifting between the conveyable state and the withdrawal state, as well as in the withdrawal state. This quite effectively prevents foreign materials from adhering to the conveyor belt 8.

The rollers 7 and 9 do not move during the state switching operation. Thus, the region of the conveyor belt 8 between the tension roller 9 and the belt roller 7 remain at the same position in the conveyable state, the withdrawal state, and while shifting between the states. Thus, even if an additional member is provided in the space below the region but above the partition plate 51, the region of the conveyor belt 8 does not contact the additional member. Thus, the present embodiment allows a member to be provided to the space, which increases the design freedom of the printer.

As illustrated with hatching in FIG. 4B, an area is formed in the withdrawal state above the conveyor surface 8*a* but below the plane including the four ejection surfaces 2*a*. A cross-sectional shape of the area is a triangle one of whose vertexes having the smallest internal angle is located around the upper end of the belt roller 7. At this time, the distance between the ejection surfaces 2*a* and the conveyor surface 8*a* is larger than the predetermined gap G in the conveyable state. Further, the vertical position of the door 1*d* is substantially the same as that of an area between the upper part of the conveyor unit 21 and the four inkjet heads 2. Thus when the door 1 provided to the front surface of the housing 1*a* is pulled open in the withdrawal state, the entire triangle area is visible through the opening 10*d*. As a result, a user is able to confirm a sheet P jammed between the conveyor surface 8*a* and the four ejection surfaces 2*a*, and easily remove the sheet P from the printer 1 through the opening 10*d*. Particularly in the present embodiment, the side wall of the housing id where the door 1*d* is provided, extends along the conveyance direction of the sheet P. Thus, the sheet P is easily removable regardless of in which part of the triangle area the sheet P is jammed.

After removing the jammed sheet P, the user closes the opened door 1*d*, and rotates the rotating knob 61 clockwise in FIG. 4B. This causes the wires 63 to wind around the shaft 61*x*, and the shaft 6*x* to move obliquely towards the upper right along the slits 64 and stop at the upper ends of the slits 64 as illustrated in FIG. 4A. At this time, the plates 42 and 44 and the platen 19 swing about the shaft 7*x* as the belt roller 6 moves upward. As the shaft 6*x* moves upward, the belt roller 6, the sliders 46, and the plates 41 and 43 to which the sliders 46 are fixed move in the direction approaching the belt roller 7 and the plates 42 and 44, the sliders 46 being guided by the U-shaped pieces 47. Thus, the conveyor unit 21 returns from the withdrawal state to the conveyable state. Thus, the printer 1 returns to the print standby state. When receiving a print instruction from, for example, a personal computer, the printer 1 sends out the uppermost sheet P in the sheet feed unit 1*b* and ejects ink from the four inkjet heads 2 while conveying the sheet P by the conveyor unit 21 to perform printing to the sheet P.

According to the printer 1 of the present embodiment, the gap between the conveyor surface 8*a* and the ejection surfaces 2*a* expands when the conveyor unit 21 is shifted from the conveyable state to the withdrawal state. This allows easy removal of a jammed sheet P. Further, the relative positional relation of the rollers 6, 7, and 9 in the conveyable state is different from those in the withdrawal state. Thus, the shape of the conveyor belt 8 can be changed into a spatially advantageous shape. That is, the gap between the conveyor surface 8*a* and the ejection surfaces 2*a* is expanded in the withdrawal state without a large space between the conveyor unit 21 and the partition plate 51. This allows the printer 1 to be smaller in the vertical direction. Particularly in the present embodiment, when the state changes from the conveyable state to the withdrawal state, while the tension roller 9 is fixed, the belt roller 6 among the belt rollers 6 and 7 defining the conveyor surface 8*a* is moved to a position where the distance between the belt roller 6 and the ejection surfaces 2*a* is smaller than the distance between the tension roller 9 and the ejection surfaces 2*a*. This allows the printer 1 to be even smaller in the vertical direction.

Further, the belt roller 6, which is a driven roller, is moved. Thus, the power transmission mechanism which rotates the shaft 7*x* does not have to be separated from the drive source. This simplifies the structure of the roller moving mechanism 60 even more. Furthermore, the belt roller 6 moves along such a path that the belt roller 6 separates from both the ejection surfaces 2*a* and the belt roller 7. This prevents the conveyor belt 8 from loosening in the withdrawal state. This allows the distance between the conveyor belt 8 and the partition plate 51 to be sufficiently short, allowing the printer 1 to be even smaller in the vertical direction.

Further, moving only the belt roller 6 among the belt rollers 6 and 7 defining the conveyor surface 8*a* shifts the state of the conveyor unit 21. This simplifies the structure of the roller moving mechanism 60. In addition, the conveyor surface 8*a* is tilted with respect to the ejection surfaces 2*a* in the withdrawal state. Thus, the gap between the leftmost inkjet head 2 in FIG. 4B and the conveyor surface 8*a* is greatly expanded. Thus, a jammed sheet P is more easily removable.

The roller moving mechanism 60 includes a guide mechanism which guides the belt roller 6 when the belt roller 6 moves. This allows the belt roller 6 to move smoothly. Particularly in the present embodiment, the slits 64 and the slide mechanisms 45 allow the structure of the roller moving mechanism 60 to be simple.

Next, the following describes a second embodiment of the present invention. In the first embodiment, only the belt roller 6 is moved among the rollers 6, 7, and 9 to shift the state of the conveyor unit 21. On the other hand in the present embodiment, both of the belt rollers 6 and 7 are moved when shifting the state of the conveyor unit 21. Note that the members same as those already described in the first embodiment will be denoted by the same reference numerals, without specific descriptions thereof.

Figure 5A:
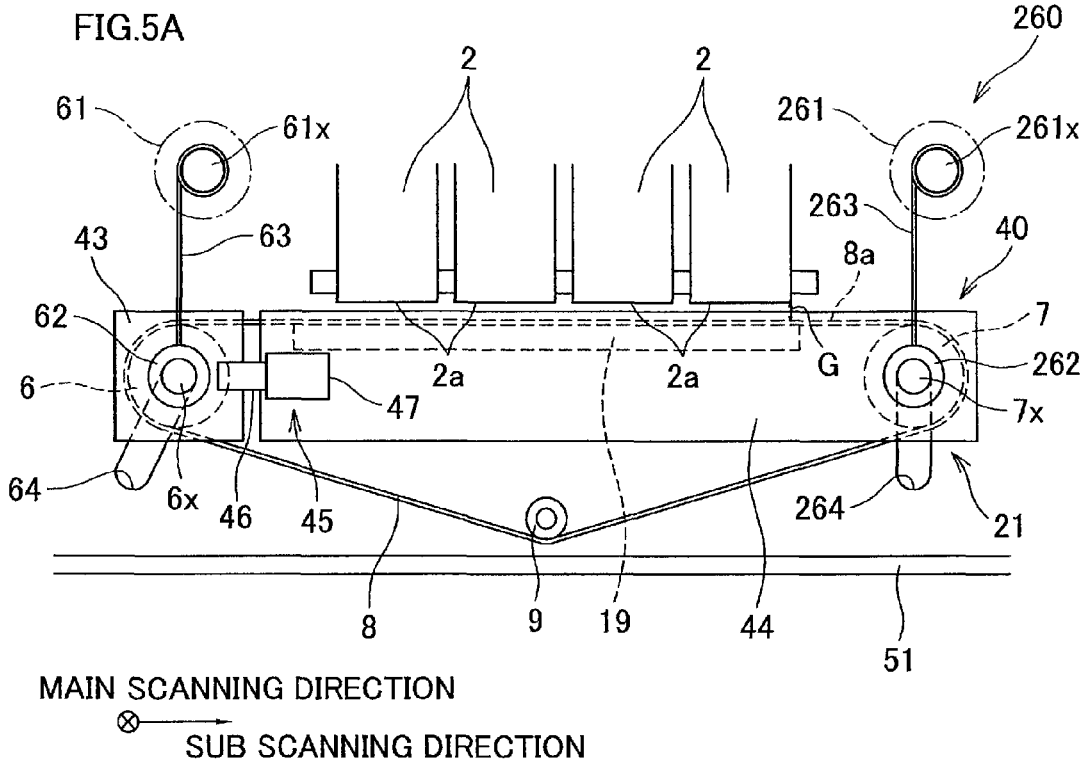
FIG. 5A and FIG. 5B are side views of moving processes of two belt rollers of an inkjet printer according to a second embodiment of the present invention.

As illustrated in FIG. 5A, a printer of the present embodiment includes a roller moving mechanism 260 which moves the belt rollers 6 and 7 to shift the conveyor unit 21 between the conveyable state and the withdrawal state. The part of the roller moving mechanism 260 which moves the belt roller 6 has the same structure as that of the first embodiment. Therefore, the following mainly describes a part of the roller moving mechanism 260 which moves the belt roller 7, omitting a detailed description of the part moving the belt roller 6. The roller moving mechanism 260 includes: a rotating knob 261 having a shaft 261*x*; two rings 262; and two wires 263, in addition to the rotating knob 61 having the shaft 61*x*, the two rings 62, the two wires 63, and the two plates 65 and 66 each having a slit 64 formed thereon (see FIG. 3). Each of the two wires 263 serves as a connecting member which connects a ring 262 and the shaft 261*x* of the rotating knob 262. The rotating knob 261 has the same structure as that of the rotating knob 61. The rotating knob 261 and the rotating knob 61 are located at the same level, interposing the four inkjet heads 2 therebetween. The two rings 262 are respectively fixed to outer surfaces of the plates 42 and 44. The shaft 7*x* of the roller 7 penetrates the rings 262 and the plates 42 and 44, enabling the belt roller 7 to rotate around the shaft 7*x*. Each of the plates 65 and 66 has a slit 264 formed thereon. The slits 264 define the rectilinear path of the movement of the belt roller 7, and guide the belt roller 7 when it moves. An upper end and a lower end of each of the slits 264 are respectively at the same level as the upper end and the lower end of the slits 64.

Portions of leading ends of the shaft 261*x* are respectively inserted into the slits 264 of the plates 65 and 66. A width of each of the slits 264 is slightly larger than the diameter of the shaft 261, which allows the shaft 261*x* to freely move along the slits 264. Each of the slits 264 has an elongated form extending vertically downward. An upper end of the slit 264 is the position of the shaft 261*x* when the conveyor unit 21 is in the conveyable state. A lower end of the slit 264 is the position of the shaft 261*x* when the conveyor unit 21 is in the withdrawal state.

One end of the each of the wires 263 is fixed to an upper end of a ring 262. The other end of the each of the wires 263 is fixed to the shaft 261*x* of the rotating knob 261. When the shaft 261*x* rotates counterclockwise to unwind the wires 263 from the shaft 261*x*, the shaft 7*x* of the belt roller 7 is guided to move down along the slits 264. Reversely, when the shaft 261*x* rotates clockwise to wind the wires 263 around the shaft 261*x*, the shaft 7*x* of the belt roller 7 is guided to move up along the slits 264. Thus, a user is able to move the belt rollers 6 and 7 by simultaneously or sequentially rotating the rotation knobs 61 and 261 in a desired direction to shift the conveyor unit 21 between the conveyable state and the withdrawal state.

Figure 5B:
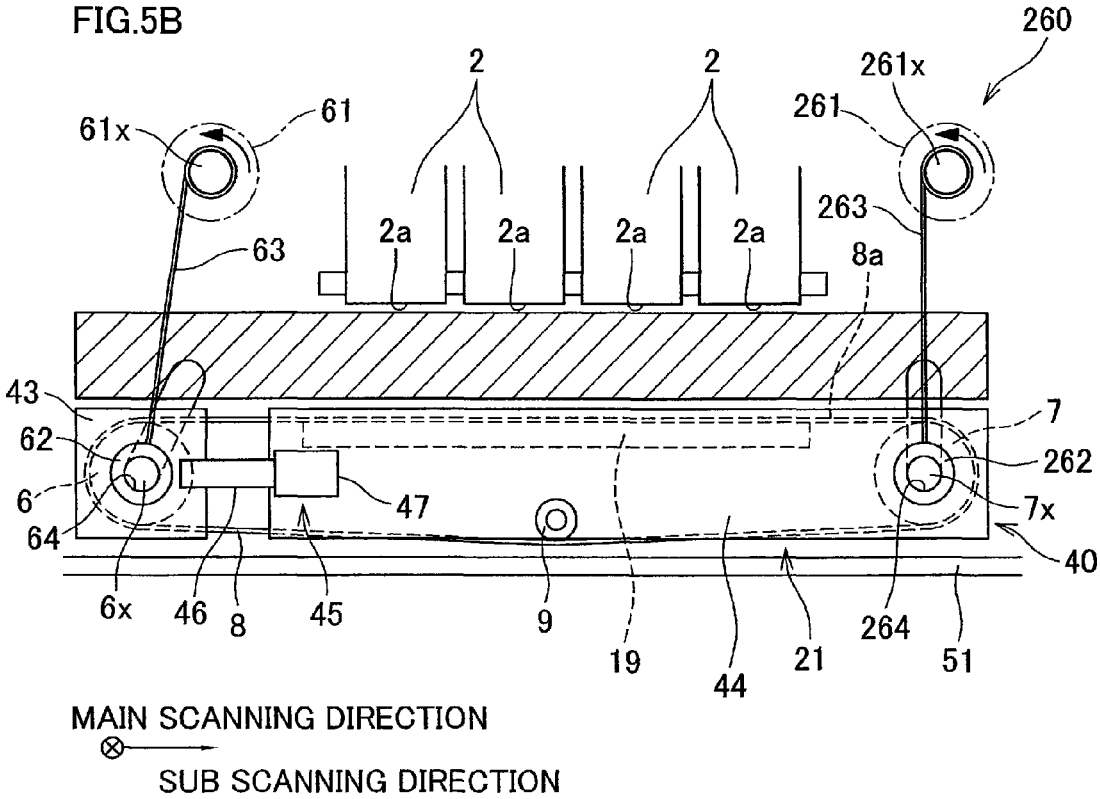

In the present embodiment, a user operates the rotating knobs 61 and 261 to rotate them counterclockwise in FIG. 5A when removing a jammed sheet P. This unwinds the two wires 63 and the two wires 263 from the shafts 61*x* and 261*x*, respectively. Accordingly, the shaft 6*x* and the rings 62 move towards the lower left along the slits 64, and the shaft 7*x* and the rings 262 move vertically downward along the slits 264. Then, the shafts 6*x* and 7*x* respectively stop at the lower ends of the slits 64 and the slits 264, as illustrated in FIG. 5B. Tension is applied to the conveyor belt 8 in the withdrawal state as in the conveyable state. As described above, the distance between the slits 64 and the belt roller 7 is the smallest at the upper ends of the slits 64. The distance increases in the direction of the lower ends of the slits 64. Thus, as the shaft 6*x* moves downward, the belt roller 6, the sliders 46, and the plates 41 and 43 to which the sliders 46 are fixed move in a direction away from the belt roller 7 and the plates 42 and 44, the sliders 46 being guided by the U-shaped pieces 47.

In the withdrawal state illustrated in FIG. 5B, the tension roller 9 remains at the same position as in the conveyable state. Meanwhile, the belt rollers 6 and 7 defining the conveyor surface 8*a* are at different positions from those in the conveyable state. In more detail, the belt rollers 6 and 7 are at such positions where the distance between the shafts of the belt rollers 6 and 7 is longer than in the conveyable state, and higher than the tension roller 9 in the vertical direction, or alternatively, the belt rollers 6 and 7 are at the same level as the tension roller 9.

In the present embodiment, the roller moving mechanism 260 moves the belt rollers 6 and 7, preventing the conveyor belt 8 from contacting the partition plate 51 in the withdrawal state, the partition plate 51 being adjacent to the conveyor belt 8 but not contacting the conveyor belt 8 in the conveyable state. At this time, the conveyor belt 8 does not loosen in the withdrawal state due to the tension applied to it. Further in the withdrawal state, the belt rollers 6 and 7 are at the positions higher than the tension roller 9 in the vertical direction. Thus, the area of the conveyor belt 8 between the belt roller 6 and the tension roller 9, or the area of the conveyor belt 8 between the belt roller 7 and the tension roller 9 reaches below the tension roller 9, and prevents the belt roller 8 from contacting the upper surface of the partition plate 51. Thus, a foreign material on the partition plate 51 such as ink does not adhere to the conveyor belt 8. Particularly in the present embodiment, the roller moving mechanism 260 moves the belt rollers 6 and 7, preventing the conveyor belt 8 from contacting the partition plate 51 while the state is being shifted between the conveyable state and the withdrawal state, as well as in the withdrawal state. This quite effectively prevents foreign materials from adhering to the conveyor belt 8.

In the withdrawal state, a region whose cross-sectional shape is rectangular is formed above the conveyor surface 8*a* but below the plane including the four ejection surfaces 2*a* therein, as illustrated by hatching in FIG. 5B. At this time, the distance between the ejection surfaces 2*a* and the conveyor surface 8*a* is larger than the predetermined gap G in the conveyable state. Further, the vertical position of the door 1*a* is substantially the same as that of an area between the upper part of the conveyor unit 21 and the four inkjet heads 2. Thus, when the door 1*d* provided to the front surface of the housing 1*a* is pulled open in the withdrawal state, the entire rectangular region is visible through the opening 10*d*. As a result, a user is able to confirm the sheet P jammed between the conveyor surface 8*a* and the four ejection surfaces 2*a*, and easily remove the sheet P from the printer 1 through the opening 10*d*. Particularly in the present embodiment, the side wall of the housing 1*a* where the door 1*d* is provided, extends along the conveyance direction of a sheet P. Thus, the sheet P is easily removable regardless of in which part of the rectangular area the sheet P is jammed. Further, the space formed between the conveyor surface 8*a* and the four ejection surfaces 2*a* can be larger than in the first embodiment by moving the belt rollers 6 and 7. Thus, a sheet P is easily removable when it is jammed.

In the above two embodiments, only the belt roller 6 or both the belt rollers 6 and 7 are moved to shift the conveyor unit 21 from the conveyable state to the withdrawal state. However, at least one of the belt rollers 6 and 7 may be moved and the tension roller 9 may be horizontally moved to shift the conveyor unit 21 between the conveyable state and the withdrawal state. Further, the conveyor unit 21 may include four or more rollers. Specifically, the conveyor unit 21 may have another tension roller provided parallel to the tension roller 9 in addition to the rollers 6, 7, and 9. In this case, only the belt roller 6 or both the belt rollers 6 and 7 may be moved to shift the conveyor unit 21 between the conveyable state and the withdrawal state, as in the above two embodiments. Further, the state of the conveyor unit 21 may be shifted between the conveyable state and the withdrawal state by horizontally moving at least one of the two tension rollers while moving at least one of the belt rollers 6 and 7. Further, the belt rollers 6 and 7 may have the function of the tension roller 9. Tension is not required to be applied to the conveyor belt 8 in the withdrawal state. The tension is also not required to be applied to the conveyor belt 8 while the state is shifting from the conveyable state to the withdrawal state.

Further, when removing a jammed sheet P in the above two embodiments, the belt roller 6 or both belt rollers 6 and 7 move as a user operates the rotating knob 61 or both the rotating knobs 61 and 261. However, the belt roller 6 or both the belt rollers 6 and 7 may be automatically moved under control of a controller of the printer 1. For instance, in case of a printer 1 incorporating a sensor which detects a sheet P jam, and a motor which drives the rotating knobs 61 and 261, the controller controls the motor so that the belt rollers 6 and 7 move to the withdrawal-state positions according to a sheet P jam detection by the sensor. After the belt rollers 6 and 7 are moved, the controller gives the user a notice to remove the sheet P. When the user having confirmed the notice opens the door 1*d*, removes the jammed sheet P from the housing 1*a*, and closes the door 1*d* thereafter, the controller controls the motor so that the belt rollers 6 and 7 return to the initial position based on the detection that the jammed sheet P has been removed and the door 1*d* has been closed. Note that in a case where only the belt roller 6 is moved, a sensor which detects a sheet P jam and a motor which drives the rotating knob 61 are to be provided, having the controller perform control as described above. The belt rollers 6 and 7 may be moved by other various methods. Further, the roller moving mechanisms 60 and 260 which shifts the state of the conveyor unit 21, are not limited to the rotating knobs 61 and 261, the rings 62 and 262, and the wires 63 and 263. The belt rollers 6 and 7 may be moved by other various components.

The partition plate 51 is not required to be provided below the conveyor unit 21 in the vertical direction. Further, the sheet feed unit 1*b* may be provided lateral to the conveyor unit 21. In such a case, a bottom part of the housing 1*a* may be provided immediately below the conveyor unit 21 as an adjoining member. This also realizes the same effects as the above mentioned embodiments.

The recording apparatus of the present invention is not limited to an inkjet printer, but can be adapted to a thermal printer. Further, the recording apparatus is not limited to a line printer, but can be adapted to a serial printer in which print heads move back and forth. Further, the present invention is not limited to a printer, but can be adapted to a facsimile machine or a photocopier. Further, the conveyor unit 21 of the present invention conveys a sheet P in the horizontal direction; however, the ejection surfaces 2*a* and the conveyor surface 8*a* may be provided tilted with respect to the horizontal direction in the conveyable state, so as to enable conveyance of the sheet P in a direction other than the horizontal direction; i.e., oblique direction or vertical direction.

The partition plate 51 is the only adjoining member provided in the above mentioned two embodiments; however, more than one adjoining members may be provided. In such a case, the roller moving mechanism preferably moves the rollers so as to prevent the conveyor belt 8 from contacting any of the adjoining members. Further, in the above mentioned two embodiments, a gap larger than the predetermined gap G exists between the entire conveyor surface 8*a* and the plane including the four ejection surfaces 2*a*. However, a gap larger than the predetermined gap G may exist between a part of the conveyor surface 8*a* and the plane including the four ejection surfaces 2*a* therein.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A recording apparatus comprising:

a recording head which has a recording surface and forms an image on a recording medium;

a conveyor unit including three rollers parallel to each other, and a conveyor belt looped around the three rollers; and a roller moving mechanism which moves at least one of the three rollers so as to allow the conveyor unit to shift between a first state and a second state, wherein the first state is a state where a conveyor surface faces the recording surface with a predetermined gap therebetween and the three rollers are in a predetermined relative positional relation so as to apply tension on the conveyor belt, and where an image can be formed by the recording head onto a recording medium supported on the conveyor surface, the conveyor surface being defined on an outer surface of the conveyor belt by two of the three rollers, the second state is a state where a gap larger than the predetermined gap exists between the conveyor surface and the recording surface, and the three rollers are in a relative positional relation different from the predetermined relative positional relation, the three rollers consist of the two rollers defining the conveyor surface, and another roller which is farther from the recording surface than the two rollers in a direction perpendicular to the recording surface, and wherein the roller moving mechanism moves, while leaving the another roller fixed, at least one of the two rollers defining the conveyor surface to a position where the distance from the recording surface to the at least one of the two rollers is the same or smaller than the distance between the another roller and the recording surface, and one of the two rollers defining the conveyor surface is a driven roller, and the roller moving mechanism moves the driven roller.

2. The recording apparatus according to claim 1, wherein the at least one of the two rollers defining the conveyor surface moves along such a path that the at least one roller moves apart from both the recording surface and the other one of the two rollers while the state is being shifted from the first state to the second state.

3. The recording apparatus according to claim 1, wherein the roller moving mechanism moves only one of the two rollers defining the conveyor surface.

4. The recording apparatus according to claim 3, wherein the conveyor surface is tilted with respect to the recording surface in the second state.

5. The recording apparatus according to claim 1, wherein the roller moving mechanism moves both of the two rollers defining the conveyor surface.

6. The recording apparatus according to claim 1, wherein the roller moving mechanism includes a guide mechanism which guides the at least one of the two rollers defining the conveyor surface when the at least one roller moves.

7. The recording apparatus according to claim 6, wherein the guide mechanism includes a plate having a slit formed thereon, and a shaft of the at least one of the two rollers to be moved by the roller moving mechanism is inserted into the slit.

8. The recording apparatus according to claim 6, wherein the guide mechanism includes a slide mechanism which enables the at least one of the two rollers defining the conveyor surface to slide in the direction connecting the two rollers.

9. The recording apparatus according to claim 1, further comprising one or more adjoining members which adjoin the conveyor belt but do not contact the conveyor belt in the first state, wherein the roller moving mechanism moves at least one of the three rollers without allowing the conveyor belt to contact any of the one or more adjoining members in the second state.

10. The recording apparatus according to claim 9, wherein the roller moving mechanism moves at least one of the three rollers so as to apply tension to the conveyor belt in the second state.

11. The roller moving mechanism according to claim 9, wherein the roller moving mechanism moves at least one of the three rollers without allowing the conveyor belt to contact any of the adjoining members while the state is shifting between the first state and the second state.

12. The recording apparatus according to claim 9, wherein the one or more adjoining members include a partition plate which is provided below the conveyor unit and which horizontally divides an inner space of the recording apparatus.

13. The recording apparatus according to claim 12, wherein a sheet feed unit is provided below the partition plate, the sheet feed unit storing a recording medium to be used for recording performed by the recording head.

14. The recording apparatus according to claim 1, further comprising a housing which stores the recording head and the conveyor unit, wherein a side wall of the housing is provided with an opening which exposes a space formed between the recording surface and the conveyor surface in the second state, and the opening is provided with an openable door.

15. The recording apparatus according to claim 14, wherein the side wall where the opening is provided extends along a direction in which the conveyor unit conveys a recording medium.

* * * * *